United States Patent [19]

Copstead

[11] 4,080,751

[45] Mar. 28, 1978

[54] INFLATABLE TOY SWORD

[76] Inventor: Terrance R. Copstead, P.O. Box 428, Issaquah, Wash. 98027

[21] Appl. No.: 714,391

[22] Filed: Aug. 16, 1976

[51] Int. Cl.[2] ..... A63H 33/00
[52] U.S. Cl. ..... 46/1 R; 46/88
[58] Field of Search ..... 46/1 R, 84, 90; 223/1 F

[56] References Cited

U.S. PATENT DOCUMENTS

| | | | |
|---|---|---|---|
| 2,669,062 | 2/1954 | Baggott | 46/88 |
| 2,864,201 | 12/1958 | Leise | 46/90 |

*Primary Examiner*—Louis G. Mancene
*Assistant Examiner*—Robert F. Cutting
*Attorney, Agent, or Firm*—Merriam, Marshall & Bicknell

[57] ABSTRACT

A toy sword having a resilient, air-inflatable blade. Means are also provided for securing a rigid handle to the resilient blade.

6 Claims, 6 Drawing Figures

FIG. 1
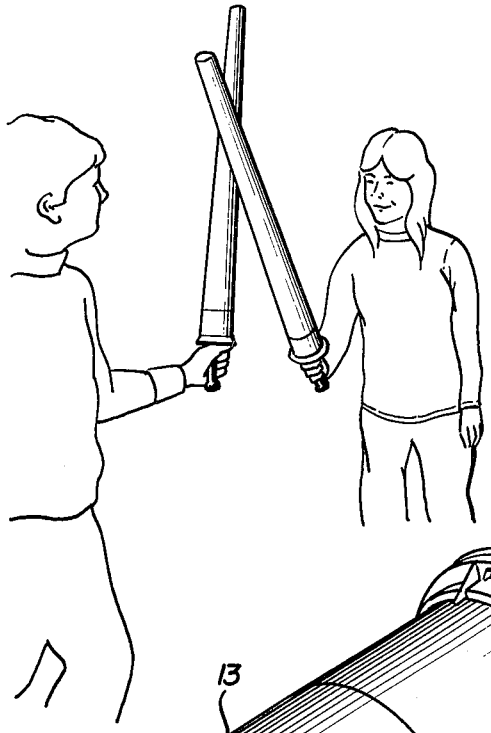
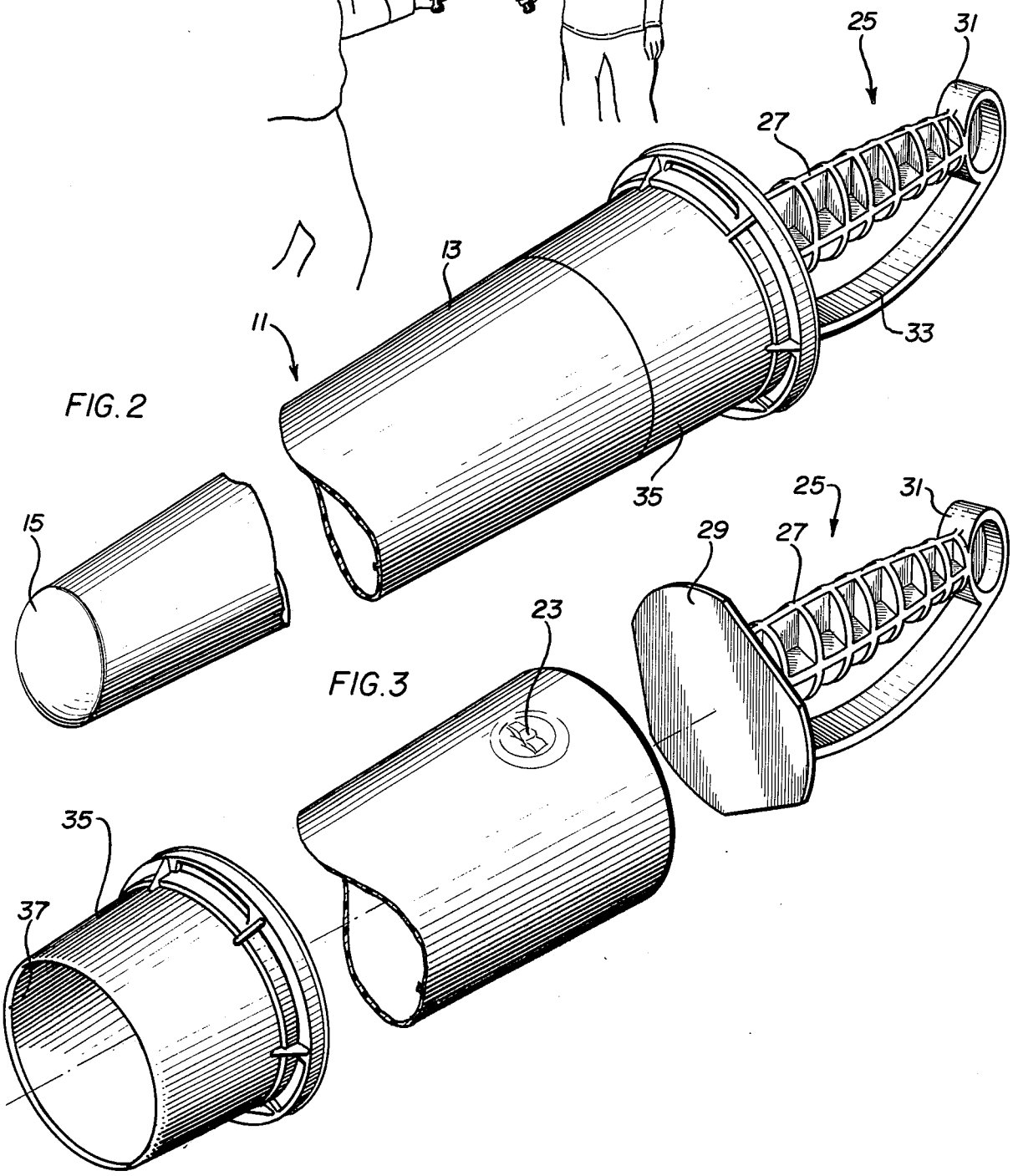
FIG. 2
FIG. 3

INFLATABLE TOY SWORD

The present invention relates generally to air inflatable toy devices and more particularly to a toy sword having an inflatable blade.

The safeness of the various toys used by children today has become of increasing concern and interest to parents, other adults, and governmental agencies. Toys are coming under increasing scrutiny with respect not only to the enjoyment the child will receive from playing with the toy, but also with respect to any physical hazzard the toy may pose to the child. It is not only toys purchased commercially, however, which may be dangerous to the child. For instance, children from time immemorial have found the use of sticks particularly inviting and have devised games of sword fighting whereby each youngster grasps a suitable stick or similar implement in hand and proceeds to fence with the other child. The danger to children from such activities is obvious. Of particular concern is that the stick may be poked into the eye of the other child rendering irreparable damage to the child's vision. Such dangers are inherent where rigid implements are used.

In accordance with the present invention, there is provided a toy sword having a resilient, air-inflated blade and which is substantially safer for use by children than toy swords or other fencing implements heretofore known. One particular embodiment of the toy sword of the present invention comprises an elongated, tubular air bag, or blade, made from a resilient air impervious sheet material and means for inflating the bag. Means are also provided for securing a rigid handle means suitable for grasping with the hand to one end of the air bag. In particular, the means for securing the handle to the air-inflatable blade includes an open-ended tubular collar which fits over one end of the air bag comprising the sword blade and includes a pair of annular surfaces facing rearwardly in from the collar in step-like fashion. The handle comprises a grip having a mounting plate at one end thereof. The periphery of the mounting plate comprises a plurality of arcuate edge segments interspersed with and joined by a plurality of straight edge segments. When assembled, a flat disc incorporated into one end of the air bag is seated against the first annular surface, preventing the air bag from being drawn completely through the collar. The handle plate is then seated against the second surface immediately adjacent the disc. During assembly, the handle plate is rotated until the arcuate edge segments are aligned with overhanging flange segments paralleling the second surface, the handle plate being secured thereby to the collar and, accordingly, the air filled blade.

The resulting inflatable toy sword of the present invention has been found to be equally stimulating to children using the devices, providing them with much entertainment and enjoyment, while at the same time being much safer and less likely to cause any permanent injury to the child.

The features of this invention which are believed to be novel are set forth with particularity in the appended claims. The invention together with its further objects and advantages thereof, may be best understood, however, by reference to the following description taken in conjunction with the accompanying drawings, in which like reference numerals identify like elements in the several figures and in which:

FIG. 1 is a pictorial representation of two children utilizing an inflatable toy device in the form of a sword in accordance with the present invention;

FIG. 2 is a perspective view of the inflatable toy sword fragmented to illustrate the construction details of the inflatable portion and of the handle;

FIG. 3 is an exploded perspective view illustrating the construction of the handle portion and of one end of the inflatable portion;

Figure 4:
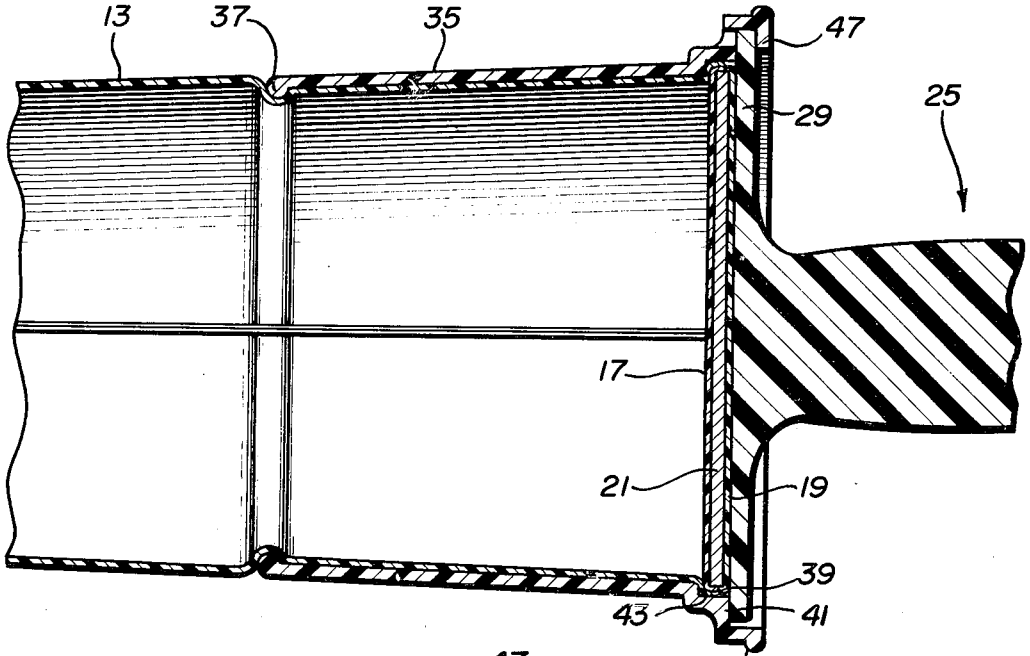
FIG. 4 is a fragmented sectional view taken along section lines 4—4 of FIG. 6 and illustrating construction details.

With reference now to FIGS. 1–4, inclusive, an embodiment comprising the toy sword of the present invention is hereinafter described in greater detail. In the illustrative embodiment shown therein, it can be seen that the toy sword comprises generally a flexible and resilient, elongated, tubular, inflatable air bag, or blade, secured to a rigid handle by a collar fitted over the blade and adapted to secure the handle thereto.

More particularly, the blade, identified generally at 11, is constructed from an air impervious, flexible, resilient sheet material such as plastic, rubber or the like. In the present embodiment, the blade 11 comprises a relatively long but narrow piece of sheet material which is overlapped along its length and heat sealed to form a long, tubular, slightly tapered casing 13. A small, substantially circular end segment 15 is similarly heat sealed at its rim to the smaller end of the casing 13 to provide a blunt surface at the smaller outer, or striking, end of the blade 11. At its other end, the casing 13 is closed by a double-walled end piece comprising an inner wall segment 17 and an outer wall segment 19 which are heat sealed together at their respective rims and to the larger end of the casing 13 with a stiffening disc 21 comprising, for example, a cardboard disc or the like, sealed between the inner and outer wall segments 17 and 19. Not only is the resulting blade structure airtight, but it is also flexible and resilient. Inflation or, as required, deflation of the blade is accomplished in the well-known manner by means of an air valve 23 of substantially conventional structure located in the casing 13 near the handle end thereof. The particular air valve 23 shown in FIG. 3 is of the type which may be depressed to lie substantially flush with the casing 13 and is in common usage in such air inflatable devices.

The handle, identified generally at 25, is molded from plastic and comprises generally a grip 27 for grasping the toy sword and an integral crossguard plate member 29 which is also used in mounting the handle to the blade as hereinafter described. Although the particular style or design of the grip 27 is not critical, in the present embodiment the grip is reticulated to impart greater structural rigidity and strength to the grip while a blunt pommel 31 is incorporated at the other end of the grip 27 to forestall serious injury to an opponent if the opponent is accidentally struck by the end of the grip. A curved hand guard 33 substantially parallels the grip 27, attaching to the crossguard plate 29 and the pommel 31, to prevent the accidental battering of the user's hand during play.

The handle 25, in turn, is secured to the blade 11 by means of an open-ended tubular collar 35 incorporating means for engaging and securing both the handle and the blade thereto. The means employed for securing the collar to the blade may be better understood by particular reference now to FIG. 4. As illustrated therein, the collar is fitted over the handle end of the blade when the toy sword is assembled. The open-ended tubular collar 35 is slightly tapered to coincide generally with the taper of the blade 11. A rounded lip 37 is provided at the narrower end of the collar to eliminate any sharp edges which might otherwise cut or puncture the casing 13.

The means employed for securing the handle 25 to the blade 11 is integrally formed with the collar 35 from plastic or the like and comprises generally a stepped pair of annular surfaces at the handle end of the collar. The outermost edge of the first annular surface 39 of the tubular collar 35 is coupled to the innermost edge of second surface 41 by a short, cylindrical wall 43 as shown in FIG. 4. The outer diameter of the annular surface 39 is slightly larger than the opening through the collar, but sufficiently wide to seat the stiff disc 21 sealed in the double-walled end piece of the blade and prevent the blade 11 from being pulled from the collar 35 through the other end thereof. The second surface 41 extends outward laterally from the other edge of the coupling wall 43. A cylindrical wall 45 extends from the outer edge of the second surface 41 to support a plurality of spaced, inwardly directed flange segments 47 paralleling the second surface 41 at a predetermined distance therefrom. In the present embodiment, three such flange segments 47 are provided.

Figure 5:
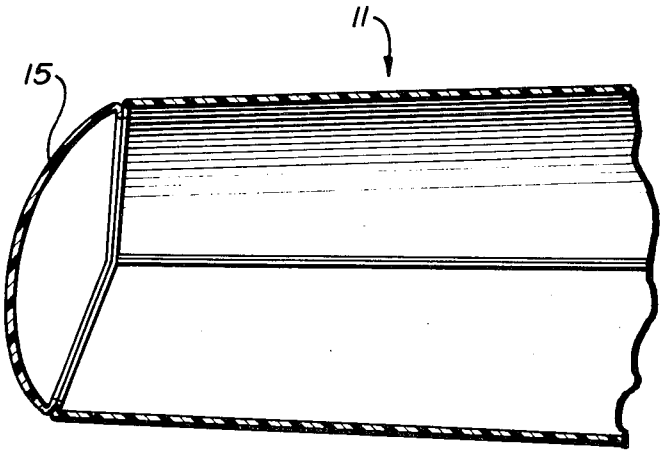
FIG. 5 is a rear view of the handle in an unlocked position during assembly of the inflatable toy sword.
Figure 5:
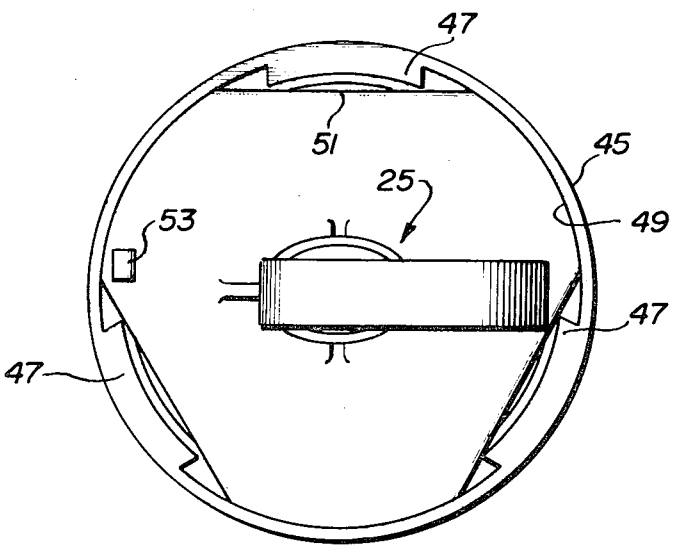

As best seen in FIG. 5, the periphery of the cross-guard or mounting plate member 29 attached to the handle grip 27 is defined by a plurality arcuate edge segments 49 interspersed with and joined by a plurality of straight edge segments 51. The arcuate edge segments 49 generally define a circle having a radius dimensioned to fit within the space defined by wall 45. When the toy sword is fully assembled, the handle plate 29 is seated on the second annular surface 41. The surface 41, the plurality of segmented flanges 47, and the handle plate 29 are dimensioned so that the straight-line edge segments 51 clear the segmented flanges 47 when they are aligned. Accordingly, the handle plate 29 can be inserted past the segmented flanges 47 to be seated on the second annular surface 41.

Figure 6:
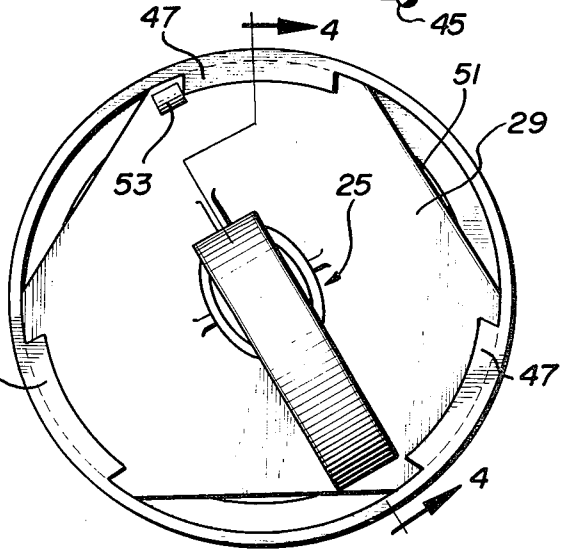
FIG. 6 is a rear view of the handle in the locked position completing the assembly.

The handle 25 is then removably secured to the blade 11 by rotating the handle until the rounded edge segments 49 of the handle plate are aligned with the flange segments 47 between the second annular surface 41 and the flange segments 47, as illustrated in FIG. 6. Because the radial dimension of the rounded edge segments 49 is substantially the same as the outer radial dimension of the second surface 41, the plate 29 is constrained between the second flange and the segmented annular surface and can not be pulled directly from the collar 35. Since the plate fits snugly between the flanges and the annular surface and does not move freely therebetween, a twisting force must be imparted to the handle 25 relative to the collar 35 in order to remove the handle. A tab 53 is provided on the top of the plate to contact one of the flange segments 47 and prevent further rotation of the handle when the handle is fully secured to the blade. Further, when assembled, the handle plate 29 is located immediately adjacent the disc 21 thereby preventing undesirable movement of the blade 11 within the collar 35. Accordingly, the handle, being secured to the blade is grasped with the hand and provides a firm structure by which to hold the resilient air-inflated blade.

Although the particular embodiment illustrated in FIG. 5 shows three arcuate edge segments 49 joined by three straight edge segments 51, it should be understood, however, that the number of segmented flanges and the periphery of the mounting plate member 29, i.e., the number of edge segments, can be varied within design and tolerance limitations without deviating in principle from this aspect of the present invention.

During assembly of the handle to the blade, the blade 11 is fully inflated and the air valve 23 depressed to be flush with the casing 13. The fully inflated blade 11 is then inserted through the collar 35 until the disc 21 in the end of the blade comes to rest on the first annular surface 39 of the collar and is prevented thereby from being withdrawn from the collar 35 through the narrower end of the collar. The handle 25 is then inserted into the collar 35 and rotated relative thereto until the handle is secured to the collar and the blade. Accordingly, the assembled toy sword hereby provided is relatively safe for use by children, easy to assemble, and simplified in construction.

While a particular embodiment of the present invention has been shown and described, it will be obvious to those skilled in the art that various changes and modifications may be made without departing from the invention in its broader aspects. Accordingly, the aim in the appended claims is to cover all such changes and modifications as may fall within the true spirit and scope of the invention.

What is claimed is:

1. A toy sword comprising:

blade means comprising an inflatable resilient tubular air bag having a forward end and a rearward end;

means for inflating said air bag;

an open-ended tubular collar having an rearwardly facing interior annular surface;

said forward end of said tubular air bag being insertable into and through said open-ended tubular collar, said tubular air bag having a stiffener disc at said rear end, said stiffener disc being dimensioned to seat against said annular surface to prevent said rear end of said tubular air bag from being pulled through said open-ended tubular collar; and means comprising a substantially rigid handle suitable for grasping with the hand, said tubular collar including means for securing said handle means to said collar to hold said stiffener disc seated against said annular surface between said handle means and said annular surface.

2. A toy sword in accordance with claim 1 wherein said handle means includes a mounting plate and wherein said means for securing said handle means to said collar comprises a second rearwardly facing interior annular surface located rearwardly of said first annular surface, said second annular surface having an opening dimensioned to pass said stiffener disc therethrough to engagement with said first annular surface, said second annular surface being dimensioned to seat said mounting plate, and a plurality of spaced segmented flanges disposed on said collar to be substantially parallel to and spaced rearwardly from said second annular surface, said mounting plate being insertable between said second annular surface and said segmented flanges.

3. A toy sword in accordance with claim 2 wherein said mounting plate has an outer periphery comprising a plurality of arcuate edge segments interspersed with and joined by a plurality of straight edge segments, said mounting plate being removably insertable past said segmented flanges to be between said second annular surface and said segmented flanges when said straight edge segments are aligned with said segmented flanges and not removable when said inserted mounting plate is rotated until said arcuate edge segments are aligned with said segmented flanges.

4. A toy sword in accordance with claim 3 including means comprising an upstanding tab at the junction of one of said arcuate edge segments, and the adjacent one of said straight edge segment, said tab engaging one of said segmented flanges to prevent further rotation of said mounting plate when said arcuate edge segments are substantially aligned with said segmented flanges.

5. A toy sword in accordance with claim 2 wherein said handle means comprises a handgrip attached to said mounting plate and extending therefrom, and wherein said handgrip includes a substantially blunt pommel, said handle means including a handguard extending from said pommel to said mounting plate in substantially parallel relation with said handgrip.

6. A toy sword in accordance with claim 1 wherein said inflation means comprises an air valve, said valve being depressed to lie substantially flush with the surface of said tubular air bag when said toy sword is assembled.

* * * * *